US005473108A

United States Patent [19]

Matsuda et al.

[11] Patent Number: 5,473,108

[45] Date of Patent: Dec. 5, 1995

[54] ELECTRONIC KEYBOARD MUSICAL INSTRUMENT CAPABLE OF VARYING A MUSICAL TONE SIGNAL ACCORDING TO THE VELOCITY OF AN OPERATED KEY

[75] Inventors: Eiji Matsuda; Gen Izumisawa; Hiroshi Kitagawa, all of Shizuoka, Japan

[73] Assignee: Kabushiki Kaisha Kawai Gakki Seisakusho, Shizuoka, Japan

[21] Appl. No.: 178,551

[22] Filed: Jan. 6, 1994

[30] Foreign Application Priority Data

| | | | |
|---|---|---|---|
| Jan. 7, 1993 | [JP] | Japan | 5-017030 |
| Jan. 7, 1993 | [JP] | Japan | 5-017031 |
| Jan. 7, 1993 | [JP] | Japan | 5-017032 |

[51] Int. Cl.[6] ..... G10H 1/12; G10H 1/46; G10H 7/00

[52] U.S. Cl. ..... 84/622; 84/626; 84/633; 84/DIG. 9; 84/DIG. 11

[58] Field of Search ..... 84/604–607, 615–620, 84/622–633, DIG. 1, DIG. 7, DIG. 9, DIG. 11

[56] References Cited

U.S. PATENT DOCUMENTS

| | | | |
|---|---|---|---|
| 4,224,856 | 9/1980 | Ando et al. | 84/615 |
| 5,025,700 | 6/1991 | Morikawa et al. | 84/DIG. 9 |
| 5,099,739 | 3/1992 | Adachi | 84/622 |
| 5,138,926 | 8/1992 | Stier et al. | 84/615 |

*Primary Examiner*—Stanley J. Witkowski

*Attorney, Agent, or Firm*—Evenson, McKeown, Edwards & Lenahan

[57] ABSTRACT

An electronic musical instrument reads data of a musical tone from a waveform memory thereof according to pitch information input thereto, to form a tone signal containing a tone amplitude signal indicative of amplitude of the musical tone. The tone signal is passed into a plurality of signal paths to be formed into a plurality of analog tone signals. The plurality of signals paths each amplify the tone amplitude signal according to a note on/off velocity, and attenuate a plurality of modifications of the tone signal, depending on or not depending on the note on/off velocity and the pitch information on the musical tone, to generate a musical tone suitably reflecting the note on/off velocity and the pitch.

19 Claims, 9 Drawing Sheets

ELECTRONIC KEYBOARD MUSICAL INSTRUMENT CAPABLE OF VARYING A MUSICAL TONE SIGNAL ACCORDING TO THE VELOCITY OF AN OPERATED KEY

BACKGROUND OF THE INVENTION

1. Field of the Invention

This invention relates to an electronic musical instrument, such as a synthesizer and an electronic piano, and more particularly to an electronic musical instrument adapted to vary a musical tone, which is produced based on a musical tone signal, depending on a note on/off velocity.

2. Prior Art

In electronic musical instruments, particularly those adapted to produce a musical tone in a manner correspondent to a selected key or keys of a keyboard thereof, such as a synthesizer, an electronic piano, an electronic organ, a single keyboard, and a tone generator module, it is a common technique to vary the musical tone in a manner responsive to the speed of depression of a key, i.e. the note on velocity. A conventional electronic musical instrument of this kind includes a plurality of waveform memories each storing data of musical tones, i.e. data of waveforms of musical tones, such as data of amplitudes and frequencies thereof, which are correspondent to a predetermined reference note on velocity peculiar thereto, and a plurality of respective readers associated therewith, which read data of a musical tone corresponding to pitch information obtained from a depressed key of the keyboard from the waveform memories associated therewith, respectively. Items of the data of the musical tone read by the readers from the waveform memories are mixed or added up to form a monaural tone signal. The tone color of the musical tone produced based on the tone signal is varied by changing the mixing ratio of the data of musical tone read from the respective waveform memories according to the note on velocity.

Therefore, the conventional electronic musical instrument must incorporate lots of waveform memories and tone data readers, which are expensive, to form a desired musical tone signal correspondent to the note on velocity, which results in increased manufacturing cost.

SUMMARY OF THE INVENTION

It is the object of the invention to provide an electronic musical instrument which is capable of varying a musical tone signal according to the velocity of a key operated, with fewer tone waveform memories, to thereby vary the color of the musical tone so as to produce a musical tone suitably reflecting a touch on a key.

To attain the above object, the present invention provides an electronic musical instrument including memory means for storing data of musical tones, a reader for reading data of a musical tone from the memory means according to pitch information input thereto corresponding to a key operated, to thereby form a tone data signal containing a tone amplitude signal indicative of an amplitude of the musical tone, and a plurality of signal paths for processing the tone data signal into a plurality of tone signals in parallel with each other.

The electronic musical instrument according to the invention is characterized in that the plurality of signal paths each comprise:

one of a plurality of amplitude control means for changing the tone amplitude signal according to a velocity of the key operated; and one of a plurality of filters having frequency characteristics different from each other.

According to the electronic musical instrument of the invention, the tone data signal dependent on the pitch is attenuated by filters, which have different frequency characteristics, of a plurality of signal paths arranged in parallel with each other, and the tone amplitude signal contained therein is changed according to the note on/off velocity, whereby output signals from the output paths belong to different ranges of frequency dependent on the frequency characteristics of the filters, respectively, and further the amplitude within a range varies according to the velocity. Therefore, it is possible to vary the color of a musical tone according to the velocity and the pitch, to thereby reproduce a musical tone suitably reflecting a touch on a key.

Preferably, the electronic musical instrument further includes a signal path having one of the plurality of amplitude control means and none of the plurality of filters.

According to this preferred embodiment, possible signal paths can be presented by fewer filters by one, and hence it is possible to reduce manufacturing cost.

Preferably, the electronic musical instrument includes selector means for selecting at least two combinations each consisting of one of the plurality of amplitude control means, and one of the plurality of filter means according to the pitch information to thereby set the plurality of signal paths.

According to this preferred embodiment, the signal paths are selected according to the pitch of the musical tone, which makes it possible to set a desired tone range and emphasize a signal in the desired tone range according to the velocity.

Alternatively, the electronic musical instrument includes selector means for selecting at least two combinations each consisting of one of the plurality of amplitude control means and one of the plurality of filter means according to the velocity to thereby set the plurality of signal paths.

According to this preferred embodiment, the signal paths are selected according to the velocity, which makes it possible to set a desired tone range and emphasize a signal in the desired tone range according to the velocity in a manner suitable for the magnitude of the velocity.

Further preferably, the electronic musical instrument further includes a signal path portion having none of the plurality of filters, and the selector means selects a combination of one of the plurality of amplitude control means, and one of the plurality of filters and the signal path portion, to set one of the plurality of the signal paths.

Preferably, the plurality of amplitude control means comprises multipliers for multiplying the tone amplitude signal contained in the tone data signal by coefficients dependent on the velocity, respectively.

Further preferably, the plurality of multipliers are formed by a first multiplier for multiplying the tone amplitude signal by a coefficient having a value proportional to magnitude of the velocity, and a second multiplier for multiplying the tone amplitude signal by a coefficient having a value inversely proportional to the magnitude of the velocity, and wherein the plurality of signal paths are two signal paths selected by selector means from combinations of the first multiplier and the second multiplier, and the plurality of filters.

According to this preferred embodiment, when the velocity is larger, i.e the touch on a key is stronger, the musical tone in a selective range is emphasized, thereby reproducing a musical tone in a more specific manner.

Further preferably, the sum of the coefficients is equal to 1.

Preferably, one of the selected two signal paths has a combination of the first multiplier and one of low-pass filters selected from the plurality of filters and having a higher cut-off frequency, and the other of the selected two signal paths has a combination of the second multiplier and the other of the low-pass filters selected from the plurality of filters and having a lower cut-off frequency.

For example, each of the plurality of filters is one of a low-pass filter, a band-pass filter, and a high-pass filter.

Preferably, the plurality of amplitude control means consist of first amplitude control means for multiplying the tone amplitude signal contained in the tone data signal by a first amplification factor dependent on the velocity and second amplitude control means for multiplying the tone amplitude signal contained in the tone data signal by a second amplification factor dependent on the velocity, and the plurality of filters consist of a low-pass filter, and a band-pass filter or a high-pass filter, the plurality of signal paths comprising a combination of the first amplitude control means and the low-pass filter and a combination of the second amplitude control means and the band-pass filter or the high-pass filter, respectively.

Preferably, the electronic musical instrument further includes a mixing circuit connected to the plurality of signal paths for adding up the plurality of tone signals delivered therefrom to thereby form a monaural tone signal or a stereophonic tone signal for a plurality of channels.

According to this preferred embodiment, the mixing circuit adds up the plurality of tone signals delivered from the plurality of signal paths to form the monaural tone signal or the stereophonic tone signal for a plurality of channels. The musical tone reproduced based on the monaural tone signal is varied in its color according to the velocity and the pitch. The musical tone reproduced based on the stereophonic tone signal for the plurality of channels is also varied in its color according to the velocity and the pitch.

The above and other objects, features, and advantages of the invention will become more apparent from the following detailed description taken in conjunction with the accompanying drawings.

DETAILED DESCRIPTION

The invention will now be described in detail with reference to the drawings showing preferred embodiments thereof.

Figure 1:
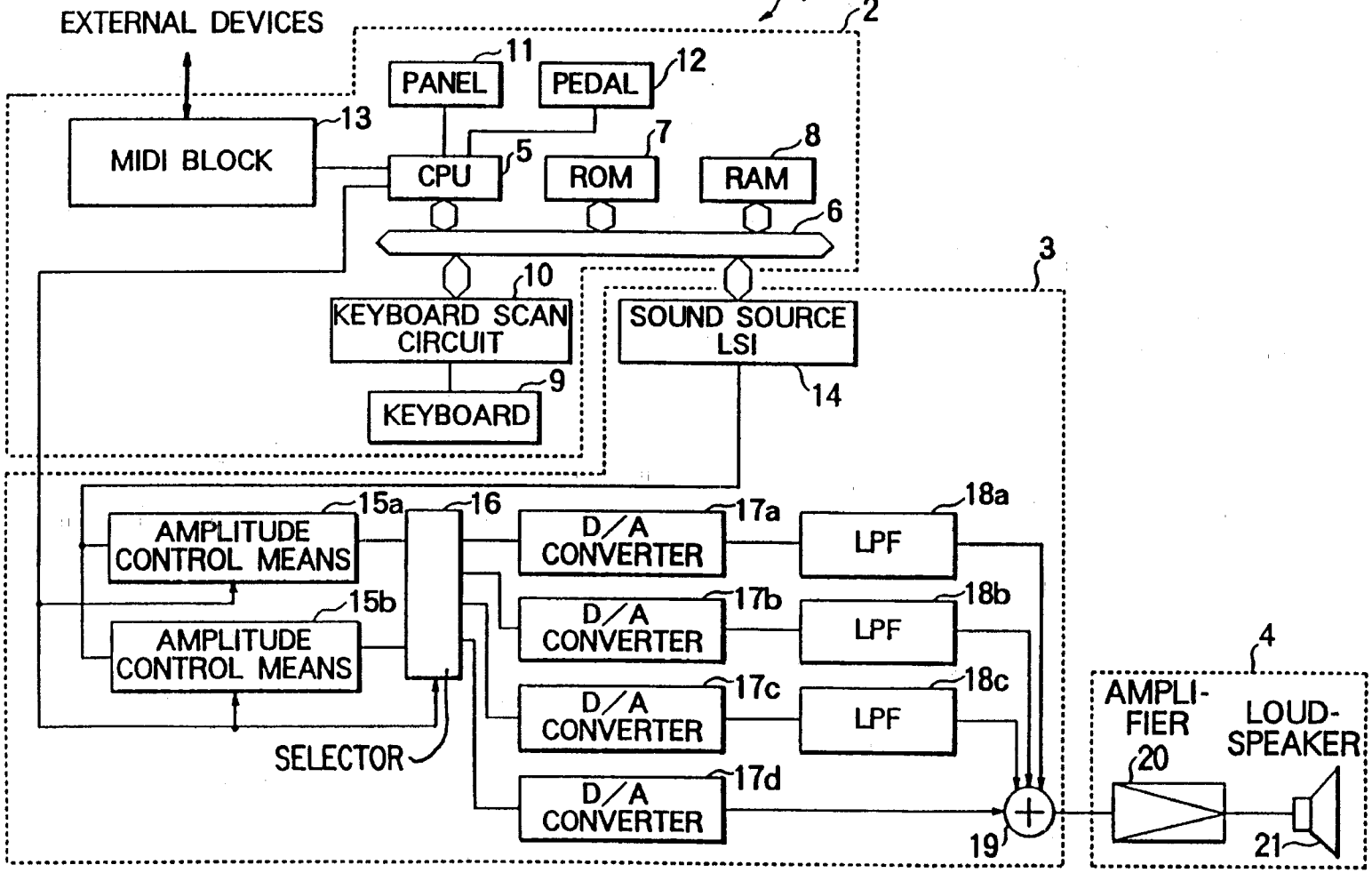
FIG. 1 is a block diagram showing the whole arrangement of an electronic musical instrument according to a first embodiment and a second embodiment of the invention.

Referring first to FIG. 1, there is shown the whole arrangement of an electronic musical instrument according to a first embodiment of the invention, in which reference numeral 1 generally designates the electronic musical instrument which comprises the main divisions of a control block 2 for controlling various operations of the electronic musical instrument 1, a tone signal-forming block 3 for forming a signal indicative of a musical tone, and a tone-reproducing block 4 for reproducing a musical tone based on the signal. The arrangement of the electronic musical instrument will be described below in further detail.

The control block 2 is comprised of a CPU (central processing unit) 5, a ROM (read only memory) 7 for storing programs executed by the CPU 5, addresses of data of musical tones, etc., a RAM (random access memory) 8 for temporarily storing results of computation by the CPU 5, etc., a keyboard scan circuit 10 for detecting note on/off information (hereinafter referred to as "the pitch information") on keys of a keyboard 9 and a note on velocity of a depressed key, and delivering the data of the pitch information and the note on velocity detected to the CPU 5, and a bus line 6 connecting these component parts with each other.

The CPU 5 has an input/output port connected to a panel 11 for effecting settings of a sound effect, etc., a pedal 12 collectively representing a damper pedal, a sostenuto pedal, and the like, and a MIDI block 13 for transmitting and receiving MIDI (Musical Instrument Digital Interface) data, e.g. of a key number and a volume of a musical tone, to and from another electronic musical instrument meeting the MIDI standard requirements. The CPU 5 performs panel event processing in response to information on the statuses of the panel 11, pedal event processing in response to information on the status of the pedal 12, control of transmitting and receiving MIDI signals via the MIDI block 13, etc.

The tone signal-forming block 3 forms a musical tone signal (finally, a monaural synthesized tone signal in the present embodiment) under the control of the CPU 5 of the control block 2, and is comprised of a sound source LSI 14, amplitude control means 15*a* and 15*b* (hereinafter collectively referred to as "the amplitude control means 15") arranged in parallel with each other, a selector 16, digital-to-analog converters (D/A converters) 17*a*, 17*b*, 17*c*, and 17*d* (hereinafter collectively referred to as "the digital-to-analog converter 17") arranged in parallel with each other, low-pass filters (LPF's) 18*a*, 18*b*, and 18*c* (hereinafter collectively referred to as "the LPF 18") connected to the digital-to-analog converters 17*a*, 17*b*, and 17*c*, respectively, and a mixing circuit 19. In this connection, although the amplitude control means 15 and the selector 16 are designated as elements within the tone signal-forming block for the sake of easy comprehension of operation performed by the electronic musical instrument, actually, the operations of the amplitude control means 15 and the selector 16 are carried out by the CPU 5 and the ROM 7.

Next, the component parts mentioned above will be briefly described in respect of their constructions and functions. The sound source LSI 14 incorporates a waveform memory for storing PCM (pulse code modulation) data of waveforms of musical tones (musical tone data) sampled and formed by PCM, a reader for reading musical tone data corresponding to the key number of a depressed key from the waveform memory as a tone data signal, and an envelope generator for controlling a tone amplitude signal contained in the tone data signal to impart a desired envelope to the tone data signal to thereby form the tone data signal into a tone signal. The sound source LSI has an input/output port connected via the bus line 6 to the CPU 5.

The amplitude control means 15 controls the tone amplitude signal contained in the tone signal delivered from the sound source LSI 14 according to the note on velocity, i.e. the velocity of key depression, thereby forming modified tone signals, as will be described in detail hereinafter.

The selector 16 selects two of the digital-to-analog converters 17*a*, 17*b*, 17*c*, and 17*d* for use, according to the note on velocity to allow the modified tone signals supplied thereto in parallel with each other from the amplitude control means 15 to be processed in parallel with each other at the following stages.

The digital-to-analog converter 17 converts the modified tone signals of PCM type into analog signals having amplitudes corresponding to the tone amplitude signals contained in the modified tone signals, respectively.

Figure 3:
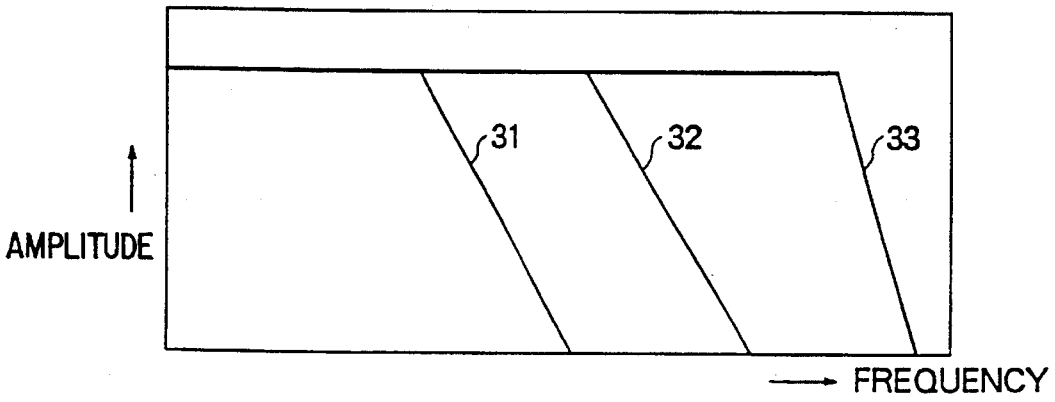
FIG. 3 is a diagram showing frequency characteristics of LPF's used in the first embodiment and the second embodiment.

The LPF's 18*a*, 18*b*, and 18*c* form LPF-series output paths which constitute the output stage of the tone signal-forming block 3 together with a through output path for permitting one of the analog tone signals to pass therethrough without changing frequency components thereof within an audio band. The through output path is formed by directly connecting an output terminal of the digital-to-analog converter 17*d* to an input terminal of the mixing circuit 19 without using any filter. This is not limitative, however, but the through output path may be formed by using a filter. For example, a low-pass filter may be used by setting the cutoff frequency thereof to a value higher than the audio band, or a high-pass filter may be used by setting the cutoff frequency thereof to a very low frequency. The low-pass filters 18*a*, 18*b*, and 18*c*, if selected for use, permit respective predetermined ranges of frequency components of the analog tone signal supplied thereto from the digital-to-analog converter 17 to pass therethrough. Reference numerals 31, 32, and 33 in FIG. 3 designate examples of frequency characteristics of the low-pass filters 18*a*, 18*b*, and 18*c*, respectively, which are made different from each other in respect of the cutoff frequency and the attenuating characteristic. The low-pass filter 18*a* has the lowest cutoff frequency, while the low-pass filter 18*b* has a higher cutoff frequency, and the low-pass filter 18*c* has the highest cutoff frequency.

The mixing circuit 19 are connected to the LPF 18 and the digital-to-analog converter 17*d* for adding up or mixing the analog tone signals delivered from the LPF 18 and the digital-to-analog converter 17*d* to form a monaural synthesized tone signal, which is then delivered to the tone-reproducing block 4.

The tone-reproducing block 4 is formed of an amplifier 20 and a loudspeaker 21. The amplifier 20 amplifies the synthesized tone signal delivered from the mixing circuit 19 and supplies the resulting signal to the loudspeaker 21 which generates a musical tone based on the synthesized tone signal amplified by the amplifier 20.

Figure 2:
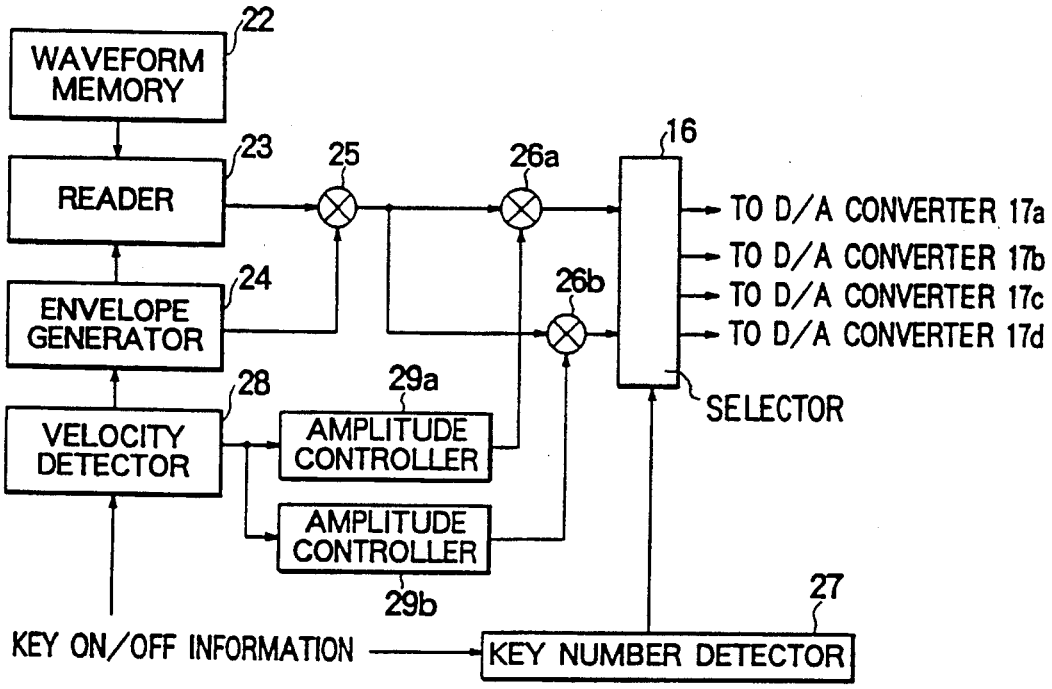
FIG. 2 is a block diagram which is useful in explaining tone signal-forming operations performed by essential parts of the electronic musical instrument according to the first embodiment.

Next, reading of the musical tone data and forming the resulting musical tone data signal into the modified tone signals by essential parts of the present embodiment will be described with reference to FIG. 2. First, the relationship between the configuration shown in FIG. 2 and that shown in FIG. 1 will be described. Reference numeral 22 in FIG. 2 designates the waveform memory, 23 the reader, 24 the envelope generator, all of which are mentioned hereinbefore with reference to FIG. 1, and 25 a multiplier. These devices are incorporated in the sound source LSI 14. Reference numerals 26*a* and 26*b* designate amplitude-controlling multipliers incorporated in the CPU 5, and 16 the selector which is actually implemented by the CPU 5, i.e. whose operation is performed by the CPU 5. Reference numeral 27 designates a key number detector for detecting the key number of a depressed key of the keyboard 9. Further, reference numeral 28 designates a velocity detector which is incorporated in the keyboard scan circuit 10 for detecting the note on velocity.

Reference numerals 29*a*, 29*b* designate amplitude controllers, which are also actually implemented by the CPU 5 and the ROM 7. The amplitude controller 29*a* and the amplitude-controlling multiplier 26*a* form the amplitude control means 15*a* appearing in FIG. 1, while the amplitude controller 29*b* and the amplitude-controlling multiplier 26*b* form the amplitude control means 15*b* appearing in same.

Next, the functions of the above essential component parts and elements will be described in detail. The waveform memory 22 stores musical tone data in a manner corresponding to keys, not shown, of the keyboard 9. The musical tone data is not particularly limited, but in the present embodiment, it is data prepared by PCM, i.e. by sampling waveforms of musical tones produced by a piano, an organ, or the like at a predetermined sampling frequency, and converting amplitudes of sampled pieces of the waveforms of musical tones into binary codes of 16 bits. The musical tone data is stored in the waveform memory 22 by assigning predetermined addresses to the binary codes of the musical tone data, respectively.

The reader 23 is supplied with the pitch information from the CPU 5, and reads musical tone data corresponding to the pitch information from the waveform memory 22 at a predetermined read speed.

The envelope generator 24 supplies envelope-forming coefficients to *the multiplier 25 to form the musical tone data read out by the reader 23, into a tone signal having an amplitude dependent on the note on velocity. The envelope generator 24 generates the envelope-forming coefficients according to various parameters of the tone signal i.e. the musical tone (waveform address data, an attack level and a decay level determining the envelope of a waveform of a musical tone to be produced, note on velocity data, etc.) delivered from the CPU 5. Further, the envelope generator 24 controls operation of the reader 23 such that the timing of its delivering an envelope-forming coefficient to the multiplier 25 and the timing of the reader 23 delivering the tone data signal to the multiplier 25 are synchronous to each other.

The multiplier 25 multiplies the tone amplitude signal contained in the tone data signal by the envelope-forming coefficient to modify the tone data signal into the tone signal such that the musical tone produced has a desired attack waveform, an intermediate envelope waveform, and a release waveform, and then delivers the resulting tone signal to the amplitude-controlling multipliers 26*a* and 26*b*.

The amplitude-controlling multipliers 26*a* and 26*b* multiply the tone signal delivered from the multiplier 25 by respective predetermined coefficients to form two modified tone signals. The predetermined coefficients are stored in the ROM 7 as data corresponding to magnitude of the note on velocity, and read out therefrom according to a detected value of the note on velocity. Further, although not particularly limited, the amplitude controller 29*a* supplies a coefficient which is inversely proportional to the magnitude of the note on velocity, i.e. which decreases as the note on velocity increases, to the amplitude-controlling multiplier 26*a*, while the amplitude controller 29*b* supplies a coefficient which is proportional to the magnitude of the note on velocity, i.e. increases as the note on velocity increases, with the sum of the coefficients being constantly equal to 1.

The selector 16 selects two of the output paths according to the pitch information to allow the modified tone signals to pass therethrough to the selected output paths. More specifically, the key number detector 27 generates the pitch information based on the key-on/off (i.e. note on/off) information on the keyboard 9 and supplies it to the selector 16. The selector 16 selects two output paths corresponding to the pitch information out of the four output paths to allow the modified tone signals input thereto from the multiplier 25 via the amplitude-controlling multipliers 26*a* and 26*b*.

The selection of two output paths by the selector is performed, for example, in the following manner: First, keys of the keyboard 9 are classified into three key number groups G1, G2, and G3 according to their key number such that the latter groups correspond to the higher key numbers, i.e. higher pitches. Further, selecting data is prepared in advance for each of the groups such that when the key number belongs to the key number group G1, the modified tone signal delivered from the amplitude-controlling multiplier 26*a* is delivered to the digital-to-analog converter 17*a*, when the key number belongs to the key number group G2, the modified tone signal is delivered to the digital-to-analog converter 17*b*, and when the key number belongs to the key number group G3, the modified Lone signal is delivered to the digital-to-analog converter 17*c*, while the modified tone signal delivered from the amplitude-controlling multiplier 26*b* is delivered to the digital-to-analog converter 17*d*, i.e. to the through output path. The selecting data is stored into the ROM 7. When the selector 16 is supplied with the pitch information indicative of the key number of a depressed key from the key number detector 27, it reads from the ROM 7 the selecting data for one of the key number groups to which the key number belongs, and selects one of the LPF-series output paths by the selecting data.

The velocity detector 28 detects a note on velocity based on a difference in time, i.e. an interval, between time points two velocity-detecting switches, not shown, provided for each of the keys of the keyboard are turned on, respectively. A signal indicative of the note on velocity detected is delivered to the envelope generator 24 and amplitude controllers 29*a*, 29*b*. In this connection, when the key on/off (note on/off) information is supplied from the MIDI block 13, the MIDI signal-receiving interruption is performed, and the CPU 4 supplies data on the note on velocity to the envelope generator 24 and the amplitude controllers 29*a*, 29*b*.

Figure 4A:
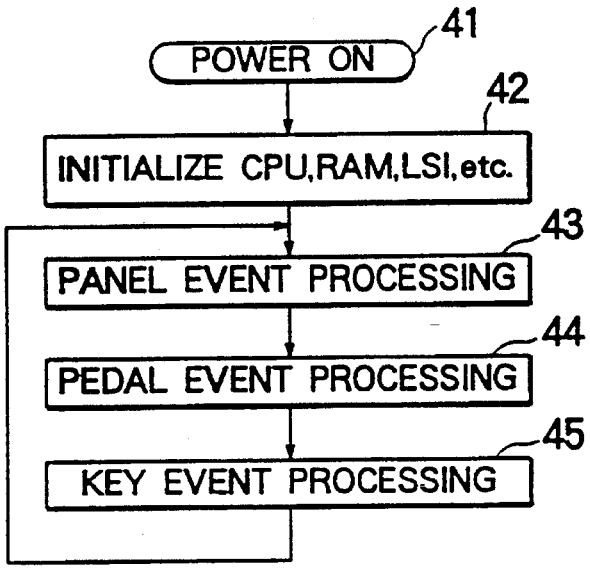
FIG. 4*a* is a flowchart of a main routine which is commonly executed by the electronic musical instruments of the first embodiment, the second embodiment, and a third embodiment.
Figure 4B:
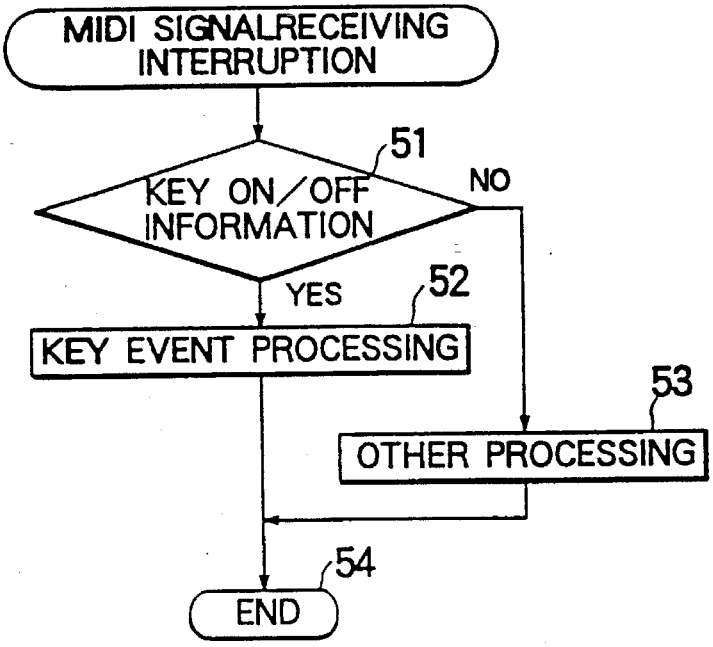
FIG. 4*b* is a flowchart of a MIDI signal-receiving interruption routine commonly executed by -the first to third embodiments.
Figure 4C:
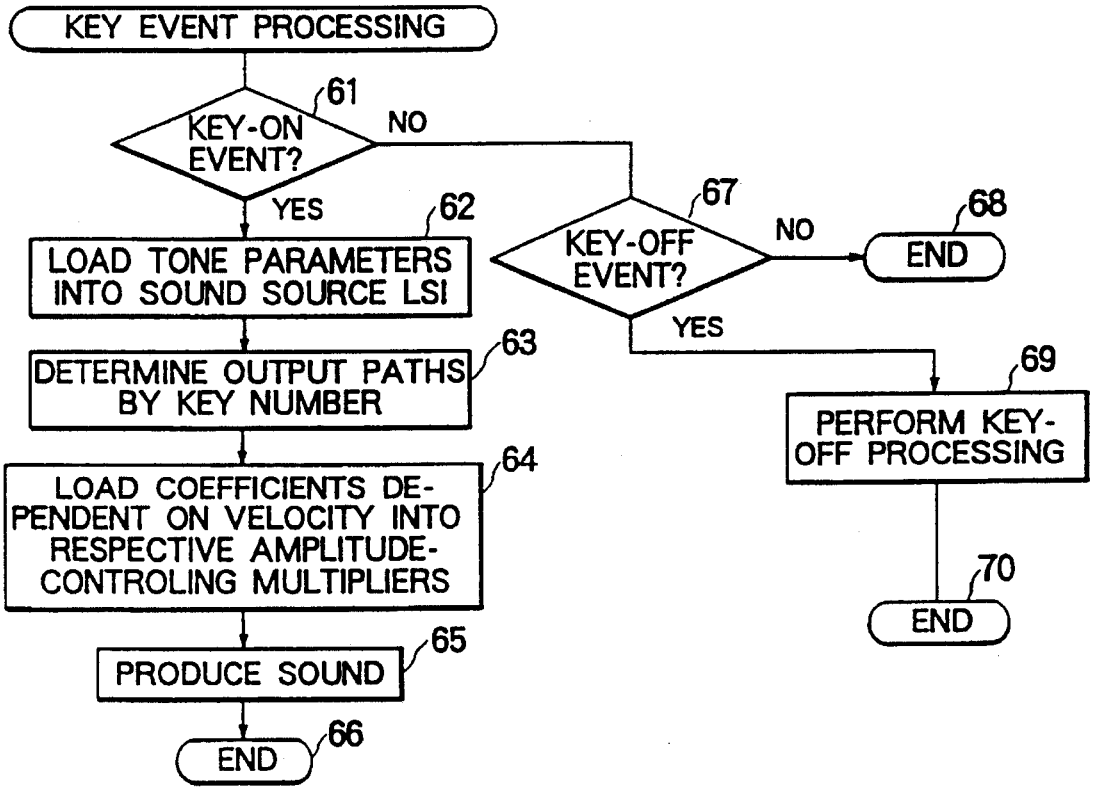
FIG. 4*c* is a key event processing routine executed at one step of the FIG. 4*a* main routine by the electronic musical instrument of the first embodiment.

Next, the operation of the electronic musical instrument will be described with reference to FIG. 4*a* to FIG. 4*c*. FIG. 4*a* shows a main routine carried out by the electronic musical instrument of the present embodiment. When a power supply switch, not shown, is turned on at a step 41, the CPU 5, the RAM 8, the sound source LSI 14, etc. are initialized at a step 42. Then, the CPU 5 performs panel event processing at a step 43 by scanning the statuses of switches, volume knobs, and the like, neither of which are shown, of the panel 11, and delivering predetermined data corresponding to the statuses of settings of the panel 11 to the sound source LSI and other related parts. Then, the CPU 5 performs pedal event processing at a step 44 by monitoring the status of the pedal 12, i.e. the statuses of the damper pedal and the like, and delivering predetermined data corresponding to the status of the pedal 12 to the sound source LSI 14 and other related parts. At the following step 45, key event processing, which will be described in detail hereinafter, is carried out.

In parallel with the main routine, a MIDI interrupt routine (MIDI signal-receiving interruption processing) is performed. This routine enables control of the electronic musical instrument by the MIDI signal. Details of the processing are described with reference to FIG. 4*b*. First, the CPU 5 makes a check as to whether or not the MIDI signal received via the MIDI block 13 contains key on/off information at a step 51. If the MIDI signal contains the key on/off (note on/off) information, the key event processing, described in detail below, is performed at a step 52, followed by terminating the program. If the MIDI signal contains information other than the key-on/off information, other processings are performed at a step 53, followed by terminating the routine. The other processings include a sound effect-creating operation for imparting a sound effect to the musical tone, e.g. imparting echoes thereto or changing the tone color, upon receiving information on pedaling operation.

Next, there will be described the key event processing for producing a musical tone in a manner corresponding to the key number and the note on velocity when a key is depressed with reference to FIG. 4*c*. First, the CPU 5 makes a check as to whether or not any key is depressed, based on the key-on/off information delivered from the keyboard scan circuit 10. If any key is depressed, i.e. if the key-on (note on) information is supplied to the CPU 5, the parameters of a tone signal for the key are loaded into the sound source LSI 14 at a step 62.

Then, the selector 16 determines output paths based on the pitch information indicative of the key number delivered from the key number detector 27 at a step 63. On the other hand, the CPU 5 delivers the signal indicative of the note on velocity to the amplitude controllers 26*a*, 26*b*, which in turn loads coefficients dependent on the note on velocity into the amplitude-controlling multipliers 29*a*, 29*b* at a step 64. Accordingly, the tone signal formed by the multiplier 25 based on the tone data signal read from the waveform memory 22 is allowed to pass through two selected paths to the mixing circuit 19, where they are added up or mixed to form the synthesized tone signal. The synthesized tone signal is amplified by the amplifier 20 and then converted into a musical tone by the loudspeaker 21 at a step 65, followed by terminating the key event processing at a step 66.

On the other hand, if the key on information is not supplied to the CPU 5 at the step 61, the CPU 5 makes a check at a step 68 as to whether or not key-off (note off) information is supplied thereto, i.e. whether or not the key depressed is released. If the answer to this question is negative (No), the key event processing is terminated at a step 68, whereas if the answer is affirmative (Yes), key-off processing dependent on pedal information supplied from the pedal 21 is performed at a step 69, for example, by changing the release speed of the waveform of the tone when the damper pedal is stepped on, followed by terminating the key event processing at a step 70.

Thus, according to the electronic musical instrument of the present embodiment described in detail heretofore, the tone signal is formed into two modified tone signals depending on the note on velocity, and at the same time the resulting two modified signals are allowed to pass through a selected one of the LPF-series output paths and the through output path according to the key number (i.e. pitch of a musical tone to be reproduced) of a key depressed. Therefore, even with an electronic musical instrument having a wide tone range for reproduction, such as an electronic piano, it is possible to reproduce a musical tone suitably reflecting a touch by imparting variation to a musical tone as described above, with a small number of waveform memories and readers.

Figure 5:
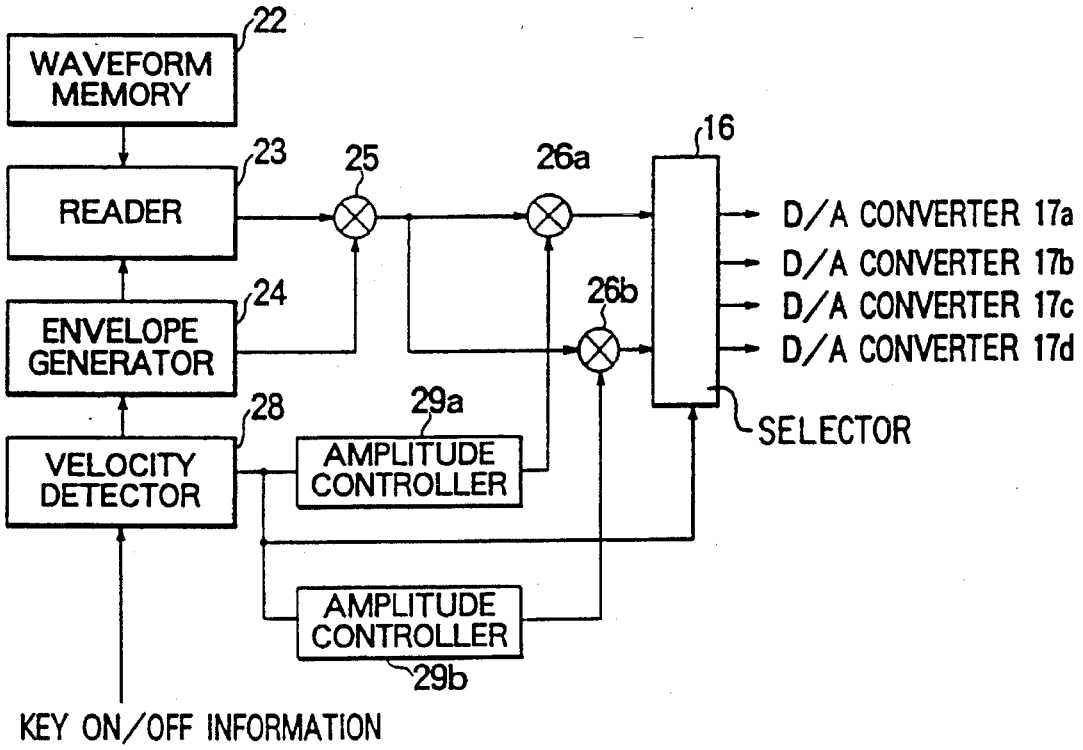
FIG. 5 is a block diagram which is useful in explaining tone signal-forming operations performed by essential parts of the electronic musical instrument according to the second embodiment.
Figure 6:
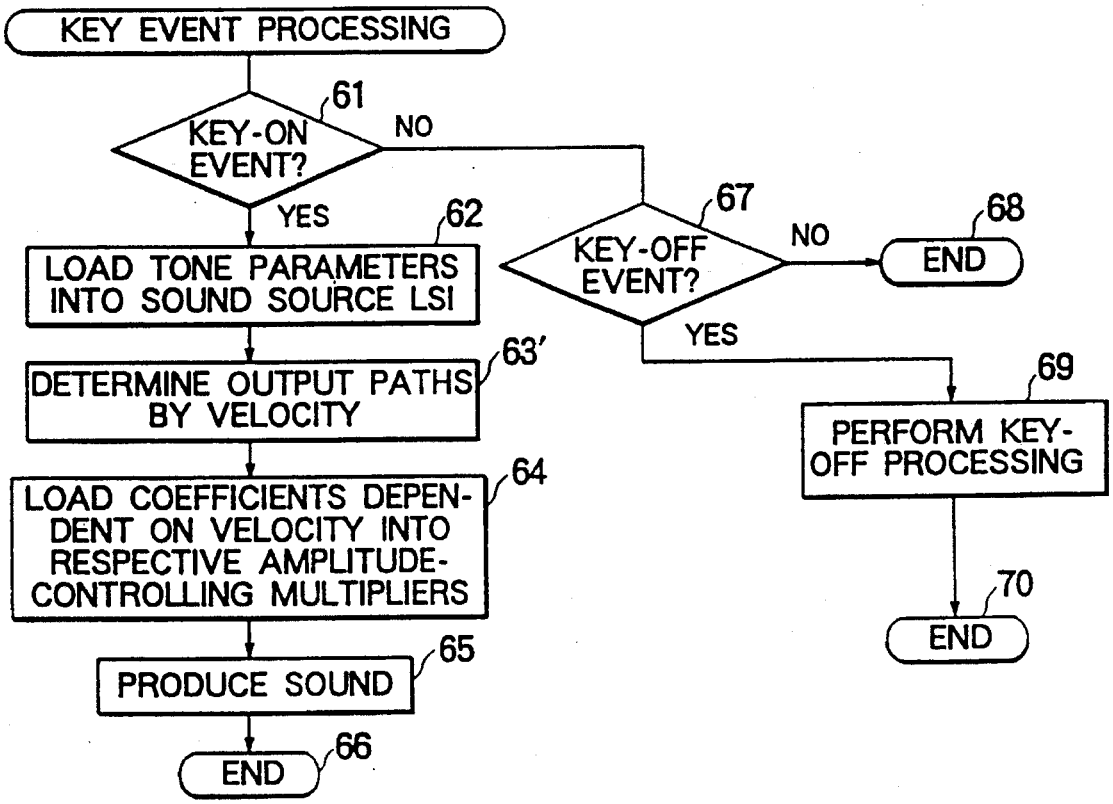
FIG. 6 is a key event processing routine executed at the one step of the FIG. 4*a* main routine by the electronic musical instrument of the second embodiment.
Figure 7:
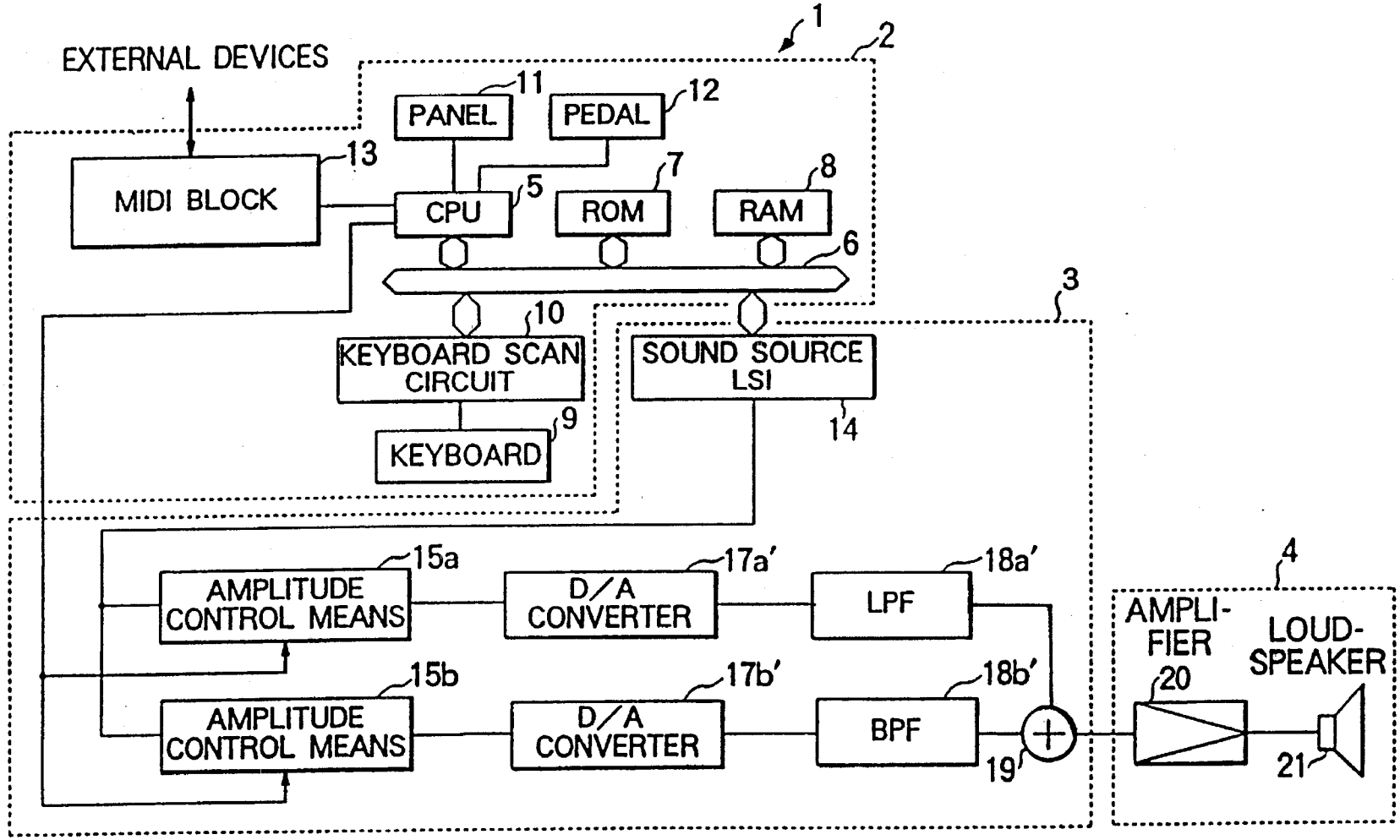
FIG. 7 is a block diagram showing the whole arrangement of an electronic musical instrument according to the third embodiment of the invention.

Next, an electronic musical instrument according to a second embodiment of the invention will be described particularly with reference to FIG. 5 and FIG. 6. The whole arrangement of the electronic musical instrument of the second embodiment is identical to that of the first embodiment shown in FIG. 1, with exception that the configuration of essential parts thereof shown in FIG. 5 is different from that of the first embodiment shown in FIG. 2, in that a parameter based on which the selector 16 selects the output paths is supplied not from the key number detector 27, which is omitted in the present embodiment, but from the velocity detector 25. More specifically, in the present embodiment, the selector 16 selects two of the four output paths according to the note on velocity detected, and delivers modified tone signals input thereto from the amplitude-controlling multipliers 26*a* and 26*b* to two digital-to-analog converters of the selected output paths, respectively.

The selection of the output paths by the selector 16 is performed, for example, in the following manner: First, values of the note on velocity are classified into three velocity groups G'1, G'2, and G'3 according to the magnitude thereof such that the latter groups correspond to the larger note on velocity values. Further, selecting data is prepared in advance for each of the groups such that when the note on velocity detected belongs to the note on velocity group G'1, G'2 or G'3, the modified tone signals delivered from the amplitude-controlling multipliers 26*a* and 26*b* are delivered to the digital-to-analog converters 17*a* and 17*b*, to the digital-to-analog converters 17*b* and 17*c*, or to the digital-to-analog converters 17*c* and 17*d*, respectively, in a manner correspondent in the mentioned order. The selecting data is stored into the ROM 7. When the selector 16 is supplied with the note on velocity from the note on velocity detector 28, it reads from the ROM 7 the selecting data corresponding to one of the note on velocity groups to which the note on velocity belongs, and selects two output paths by the selecting data.

Further, note on velocity values belonging to the same note on velocity group differently determine the coefficients used in the amplitude-controlling multipliers 26*a* and 26*b*, i.e. such that as the note on velocity increases, the coefficient used in the amplitude-controlling multiplier 20*a* decreases, whereas the coefficient used in the amplitude-controlling multiplier 20*b* increases. Therefore, if the note on velocity is large, the amplitude of a modified tone signal supplied to an output path having an LPF with a higher cut-off frequency or no LPF is larger than the amplitude of a modified tone signal suppled to an output path having an LPF with a lower cut-off frequency, so that a musical tone output from the loudspeaker 21 has higher frequency components which are greater in amplitude than lower frequency components thereof. Further, the LPF's 18*b* and 18*c* selected by the note on velocity group, G'2 have higher cut-off frequencies than those of the corresponding LPF's 18*a* and 18*b* selected by the note on velocity group G'1, respectively, and the through output path selected by the note on velocity group G'3 have no cut-off frequency and the LPF 18*c* selected by same has a higher cut-off frequency than the corresponding LPF 18*b* selected by the note on velocity group G'2. As a result, the musical tone output from the loudspeaker 2 contains a higher and wider range of frequency components in proportion to the magnitude of the note on velocity. This makes it possible to change the tone color such that the tone reproduced is emphasized in its higher tone range in proportion to the note on velocity, i.e. the velocity of depression of a key.

The electronic musical instrument of the present embodiment operates in the same manner as that of the first embodiment, according to the routines described hereinabove with reference to FIG. 4*a* and FIG. 4*b*. However, the key event processing is executed in the present embodiment according to a routine shown in FIG. 6. This routine is distinguished from the FIG. 4*c* routine of the first embodiment in that at a step 63' thereof, the output paths are determined or selected according to the note on velocity.

Thus, according to the present embodiment, the tone signal is formed into two modified tone signals depending on the note on velocity, and at the same time the resulting two modified signals are caused to pass through a combination of output paths suitably selected from the LPF-series output paths and the through output path according to the note on velocity. Therefore, even with an electronic musical instrument having a wide tone range for reproduction, such as an electronic piano, it is possible to reproduce a musical tone suitably reflecting a touch by imparting variation to a musical tone as described above, with a small number of waveform memories and readers.

Next, an electronic musical instrument according to a third embodiment of the invention will be described particularly with reference to FIG. 7 to FIG. 10. This embodiment is distinguished from the first and second embodiments described above in that as shown in FIG. 7, the present embodiment is simplified in its whole arrangement. In the present embodiment, the selector 16 is omitted and the construction of the output paths is simplified such that the amplitude-controlling multiplier 15*a* is connected to a digital-to-analog converter 17*a'* which in turn is connected to a low-pass filter (LPF) 18*a'* while the amplitude-controlling multiplier 15*b* is connected to a digital-to-analog converter 17*b'* which in turn is connected to a band-pass filter (BPF) 18*b'*.

Figure 8:
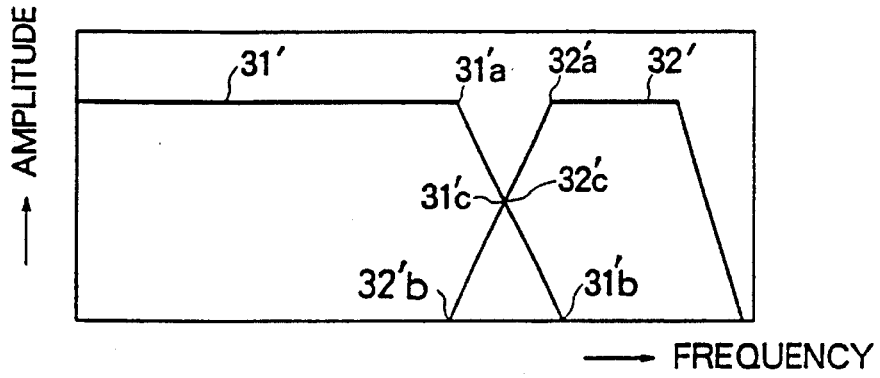
FIG. 8 is a diagram showing frequency characteristics of an LPF and a BPF used in the third embodiment.

Referring to FIG. 8, reference numerals 31' and 32' designate an example of frequency characteristics of the LPF 18*a*' and the BPF 18*b*', respectively. In this example, a frequency 31'*a* immediately lower than its attenuation region at which the output from the LPF 18*a*' starts to be reduced in amplitude coincides with a frequency 32*b*' at which the attenuation by the BPF 18*b*' on the lower frequency side reaches 20 dB, while a frequency 31'*b* at which the attenuation by the LPF 18*a*' reaches 20 dB coincides with a frequency 32'*a* at which the output from the BPF 18*b*' starts to be reduced in amplitude on the lower frequency side. Further, the LPF 18*a*' has a cut-off frequency 31'*c* which coincides with a cut-off frequency 32'*c* of the BPF 18*b*' on the lower frequency side thereof. Therefore, in a transitional region related to the cut-off frequency of the LPF 18*a*' and that of the BPF 18*b*' on the lower frequency side, assuming that signals (modified tone signals in the present embodiment) having frequency components in the transitional region which are identical in amplitude are supplied to the LPF 18*a*' and the BPF 18*b*', respectively, the amplitude of the sum of these components output from the these filters is substantially constant. Further, the cut-off frequency of the BPF 18*b*' on the higher frequency side is set to the highest frequency of the audio band.

Figure 9:
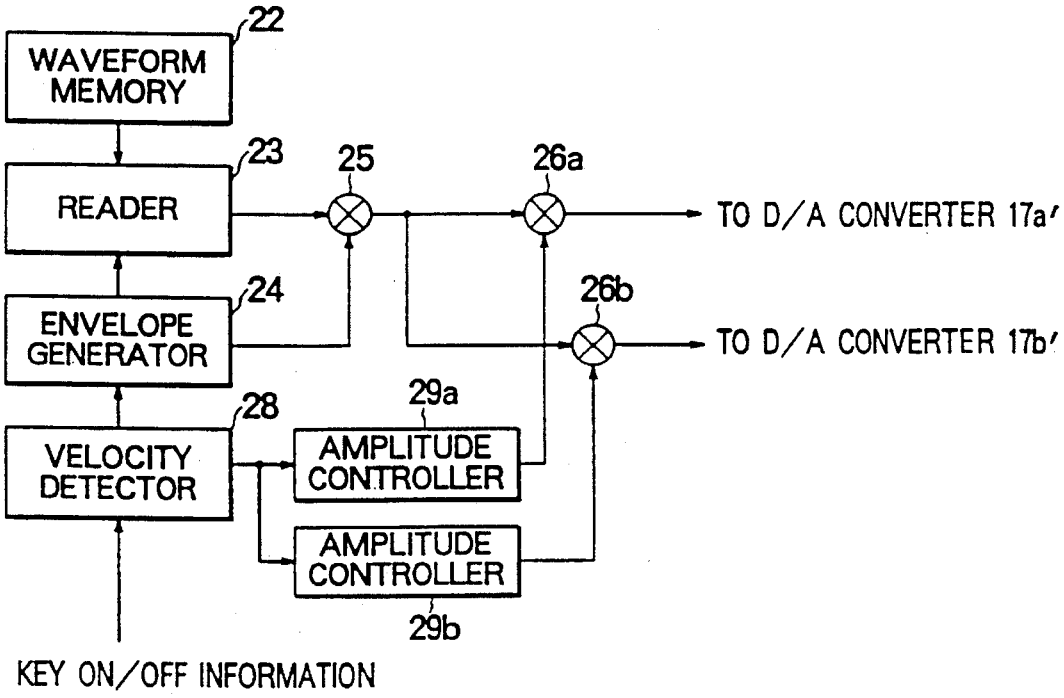
FIG. 9 is a block diagram which is useful in explaining tone signal-forming operations performed by essential parts of the electronic musical instrument according to the third embodiment.
Figure 10:
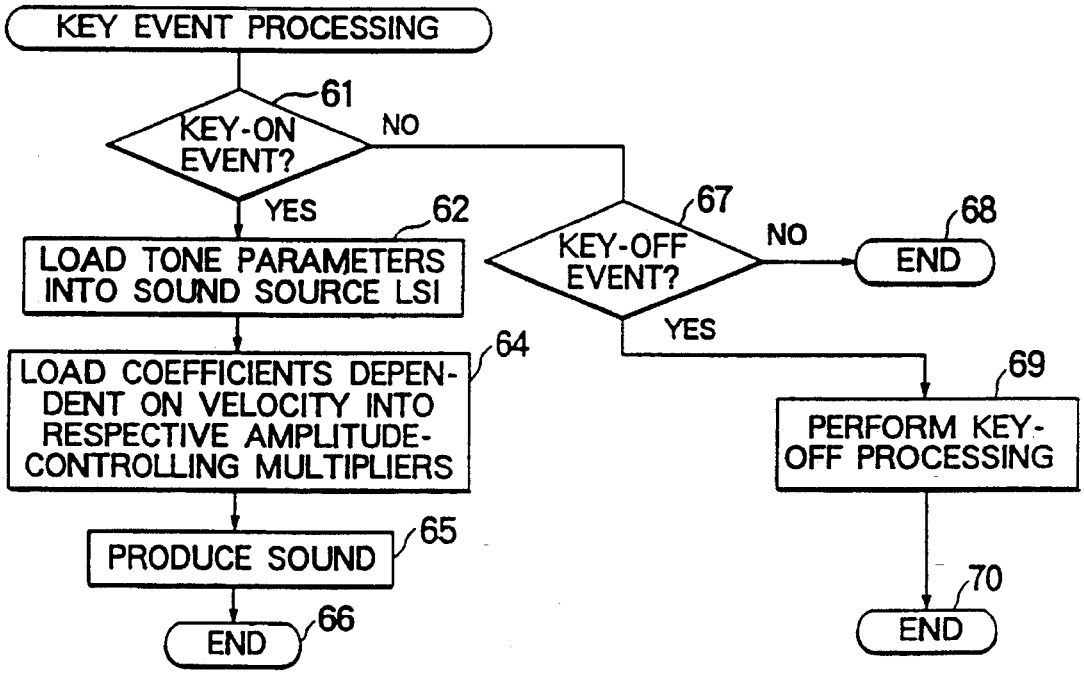
FIG. 10 is a key event processing routine executed at the one step of the FIG. 4*a* main routine by the electronic musical instrument of the third embodiment.

FIG. 9 shows the configuration of essential parts of the third embodiment, which is distinguished from that of the first embodiment described with reference to FIG. 2 in that the key number detector 27 and the selector 16 are omitted. Therefore, the modified tone signals delivered from the amplitude-controlling multipliers 26*a* and 26*b* are delivered via the digital-to-analog converters 17*a*' and 17*b*' to the LPF 18*a*' and the BPF 18*b*', respectively.

As the note on velocity increases, the analog tone signal delivered from the BPF 18*b*' becomes larger in amplitude than that delivered from the LPF 18*a*'. On the other hand, since the frequency characteristics of the LPF 18*a*' and the BPF 18*b*' are set as described above, a musical tone output from the loudspeaker 21 contains, also depending on the coefficients set by the amplitude controllers 29*a* and 29*b*, higher frequency components which are larger in amplitude than lower frequency components, with the volume of the musical tone remaining substantially constant. Therefore, the color of the musical tone is varied according to the note on velocity.

The electronic musical instrument of the present embodiment operates in the same manner as the first embodiment, according to the routines described hereinabove with reference to FIG. 4*a* and FIG. 4*b*. However, the key event processing is executed in the present embodiment according to a routine shown in FIG. 10. This routine is distinguished from the FIG. 4*c* routine of the first embodiment in that the step 63 is omitted and the selection of the output paths is not performed.

Thus, according to the present embodiment, the tone signal is formed into two modified tone signals having amplitudes dependent on the note on velocity, and at the same time the resulting two modified signals are caused to pass through a plurality of output paths having different frequency characteristics, whereby it is made possible to reproduce a musical tone suitably reflecting a touch by imparting variation to a tone as described above, with a small number of waveform memories and readers.

This invention is by no means limited to the above embodiments described only by way of example. For example, the amplitude control means 15 may be arranged at a latter stage than the output paths described in the above embodiments, whereby a plurality of tone signals corresponding to an identical pitch and subjected to attenuation by output paths selectively determined according to the pitch or the note on velocity may be amplified then according to the note on velocity.

Further, filters are not limited to LPF's and BPF's used in the above embodiments, but a high-pass filter (HPF) may be used, and the number of output paths is not limited. Further, a combination of output paths, whether it may be selective or fixed, is not limited to the examples of the above embodiments, but can be realized as desired.

Further, filters are not limited to analog filters. There may be employed digital filters to thereby convert outputs from the digital filters into analog signals by digital-to-analog converters arranged at a latter stage. Further, a manner of operation of the electronic musical instrument is not limited to those described with reference to flowcharts of programs, but changes and modifications made without departing the spirit and scope of the present invention are included in the present invention.

Further, although in the above embodiments, cases are described in which a monaural musical tone is generated or reproduced, this is not limitative but a plurality of mixing circuits may be provided to add up a plurality of analog tone signals delivered from the LPF 18 to thereby generate a stereophonic musical tone via a plurality of channels of signals. Further, the first and second embodiments may be modified, for example, such that the amplitude control means are provided in a manner corresponding in number to the output paths, and output terminals thereof are directly connected to digital-to-analog converters 17 without the selector 16, whereby the output paths for actual use may be determined by setting the coefficient of 0 to the amplitude controls means.

Further, although in the above embodiments, description is made of a case where the musical tone is varied according to the note on velocity, this is not limitative, but the note off velocity may be similarly used, singly or in combination with the note on velocity, to modify the musical tone.

What is claimed is:

1. In an electronic musical instrument including memory means for storing data of musical tones, a reader for reading data of a musical tone from said memory means according to pitch information input thereto corresponding to a key operated, to thereby form a tone data signal containing a tone amplitude signal indicative of an amplitude of said musical tone, dividing means for dividing said tone data signal into a plurality of tone data signals, and a plurality of signal paths each for processing one of said plurality of tone data signals into a tone signal the improvement wherein said plurality of signal paths each comprise:

one of a plurality of amplitude control means for changing said tone amplitude signal according to a velocity of said key operated; and one of a plurality of filters having constant frequency characteristics different from each other.

2. An electronic musical instrument according to claim 1, further including a signal path having one of said plurality of amplitude control means and none of said plurality of filters.

3. An electronic musical instrument according to claim 1, including selector means for selecting at least two combinations each consisting of one of said plurality of amplitude control means and one of said plurality of filter means, according to said pitch information to thereby set said plurality of signal paths.

4. An electronic musical instrument according to claim 1, including selector means for selecting at least two combinations each consisting of one of said plurality of amplitude control means and one of said plurality of filter means according to said velocity to thereby set said plurality of signal paths.

5. An electronic musical instrument according to claim 3, further including a signal path portion having none of said plurality of filters, wherein said selector means selects a combination of one of said plurality of amplitude control means, and one of said plurality of filters and said signal path portion, to set one of said plurality of said signal paths.

6. An electronic musical instrument according to claim 4, further including a signal path portion having none of said plurality of filters, wherein said selector means selects a combination of one of said plurality of amplitude control means, and one of said plurality of filters and said signal path portion, to set one of said plurality of said signal paths.

7. An electronic musical instrument according to claim 1, wherein said plurality of amplitude control means comprises multipliers for multiplying said tone amplitude signal contained in said tone data signal by coefficients dependent on said velocity, respectively.

8. An electronic musical instrument according to claim 7, wherein said plurality of multipliers are formed by a first multiplier for multiplying said tone amplitude signal by a coefficient having a value proportional to magnitude of said velocity, and a second multiplier for multiplying said tone amplitude signal by a coefficient having a value inversely proportional to said magnitude of said velocity, and wherein said plurality of signal paths are two signal paths selected by selector means from combinations of said first multiplier and said second multiplier, and said plurality of filters.

9. An electronic musical instrument according to claim 7, wherein the sum of said coefficients is equal to 1.

10. An electronic musical instrument according to claim 8, wherein one of said selected two signal paths has a combination of said first multiplier and one of low-pass filters selected from said plurality of filters and having a higher cut-off frequency, and the other of said selected two signal paths has a combination of said second multiplier and the other of said low-pass filters selected from said plurality of filters and having a lower cut-off frequency.

11. An electronic musical instrument according to claim 1, wherein each of said plurality of filters is one of a low-pass filter, a band-pass filter, and a high-pass filter.

12. An electronic musical instrument according to claim 1, wherein said plurality of amplitude control means consist of first amplitude control means for multiplying said tone amplitude signal contained in said tone data signal by a first amplification factor dependent on said velocity and second amplitude control means for multiplying said tone amplitude signal contained in said tone data signal by a second amplification factor dependent on said velocity, and wherein said plurality of filers consist of a low-pass filter, and a band-pass filter or a high-pass filter, said plurality of signal paths comprising a combination of said first amplitude control means and said low-pass filter and a combination of said second amplitude control means and said band-pass filter or said high-pass filter, respectively.

13. An electronic musical instrument according to claim 1, further including a mixing circuit connected to said plurality of signal paths for adding up said plurality of tone signals delivered therefrom to thereby form a monaural tone signal or a stereophonic tone signal for a plurality of channels.

14. An electronic musical instrument according to claim 2, further including a mixing circuit connected to said plurality of signal paths for adding up said plurality of tone signals delivered therefrom to thereby form a monaural tone signal or a stereophonic tone signal for a plurality of channels.

15. An electronic musical instrument according to claim 3, further including a mixing circuit connected to said plurality of signal paths for adding up said plurality of tone signals delivered therefrom to thereby form a monaural tone signal or a stereophonic tone signal for a plurality of channels.

16. An electronic musical instrument according to claim 4, further including a mixing circuit connected to said plurality of signal paths for adding up said plurality of tone signals delivered therefrom to thereby form a monaural tone signal or a stereophonic tone signal for a plurality of channels.

17. An electronic musical instrument according to claim 5, further including a mixing circuit connected to said plurality of signal paths for adding up said plurality of tone signals delivered therefrom to thereby form a monaural tone signal or a stereophonic tone signal for a plurality of channels.

18. An electronic musical instrument according to claim 6, further including a mixing circuit connected to said plurality of signal paths for adding up said plurality of tone signals delivered therefrom to thereby form a monaural tone signal or a stereophonic tone signal for a plurality of channels.

19. An electronic musical instrument according to claim 13, further including a mixing circuit connected to said plurality of signal paths for adding up said plurality of tone signals delivered therefrom to thereby form a monaural tone signal or a stereophonic tone signal for a plurality of channels.

* * * * *